US006063451A

United States Patent [19]

Murata et al.

[11] Patent Number: 6,063,451

[45] Date of Patent: May 16, 2000

[54] METHOD FOR CONTROLLING AMOUNT OF ELECTRIC CHARGE ON FINELY DIVIDED SPRAYED POWDER

[75] Inventors: Hiroshi Murata; Hiromi Omura, both of Saitama-Ken; Fumio Hara, Tokyo, all of Japan

[73] Assignees: Nisshin Flour Milling Co., Ltd.; Nisshin Engineering Co., Ltd., both of Tokyo, Japan

[21] Appl. No.: 09/136,288

[22] Filed: Aug. 19, 1998

[30] Foreign Application Priority Data

Aug. 19, 1997 [JP] Japan ..... 9-222607

[51] Int. Cl.[7] ..... B05D 1/06

[52] U.S. Cl. ..... 427/475; 427/480; 427/485; 427/486; 427/458; 361/227

[58] Field of Search ..... 427/475, 480, 427/485, 486, 458; 361/227, 226, 225; 118/621

[56] References Cited

U.S. PATENT DOCUMENTS 4,597,534 7/1986 Ruud .

5,000,624 3/1991 Steiger .

5,332,133 7/1994 Murata et al. .

*Primary Examiner*—Fred J. Parker

*Attorney, Agent, or Firm*—Young & Thompson

[57] ABSTRACT

A method for controlling an amount of electric charge on a finely divided powder. When the finely divided powder is supplied into a powder transportation pipe in a substantially discrete particle state and transported therethrough in a discrete particle state by a stream of a compressed gas having a very small water content whose dew-point is 0° C. or less, electric charge is inevitably produced by friction on the powder by the collision thereof against the inner wall of the transportation pipe. By controlling the dew-point of the compressed gas, the amount of frictional electric charge produced on the powder can be controlled even if there is a change in the type of the finely divided powder, the piping system, the spray nozzle, the type and state of the gas serving as a carrier medium, and environmental conditions such as the atmosphere. Further, a finely divided powder spraying method and apparatus uniformly spray the powder, whose amount of frictional electric charge is controlled as described above, onto a grounded sheet surface in a discrete particle state by means of a two-dimensionally-swinging nozzle.

8 Claims, 5 Drawing Sheets

DEW-POINT AND ABSOLUTE HUMIDITY

RELATIONSHIP BETWEEN DEW-POINT AND AMOUNT OF ELECTRIC CHARGE

RELATIONSHIP BETWEEN DEW-POINT AND AMOUNT OF ELECTRIC CHARGE

METHOD FOR CONTROLLING AMOUNT OF ELECTRIC CHARGE ON FINELY DIVIDED SPRAYED POWDER

BACKGROUND OF THE INVENTION

1. Field of the Invention

The present invention relates to a method and an apparatus for controlling the amount of electric charge on a finely divided powder such as, for example, liquid crystal spacers and interposed between the glass sheet of a liquid crystal substrate, which constitutes a liquid crystal display panel of a liquid crystal display device, and another glass sheet, when the finely divided powder is transported using a carrier medium gas having a very small water content (low humidity) and a dew-point of, for example, 0° C. or less as well as to a finely divided powder spraying method and apparatus for uniformly spraying the finely divided powder in a strictly controlled amount using the above method and apparatus.

2. Description of the Related Art

At present, the liquid crystal panel of liquid crystal display devices and so on is arranged such that a trace amount of liquid crystal spacers having a particle size of several microns are interposed between the glass sheet of a liquid crystal substrate and another glass sheet for holding the glass sheet. These liquid crystal spacers are formed in a single layer in a discrete state and the amount thereof is up to several thousands of particles, such as, for example, 10 to 2000 particles in a unit area of 1 $mm^2$. Various plastic particles and silica particles are used as the liquid crystal spacers.

For the above purpose, there is used a liquid crystal spacer spraying apparatus for uniformly spraying a prescribed amount of the liquid crystal particles onto the glass sheet of the liquid crystal substrate in a single layer.

As the liquid crystal spacer spraying apparatus, there have been used spraying apparatuses for uniformly spraying liquid crystal spacers onto a glass substrate by suspending the liquid crystal spacers in a liquid of chlorofluorocarbons or the like in a colloid state, uniformly spraying the spacers onto the glass sheet in a liquid state and vaporizing the liquid of chlorofluorocarbons or the like. However, the spraying apparatuses using chlorofluorocarbons or the like cannot be used because they are restricted or prohibited due to the problem of environmental pollution.

To cope with the above circumstances, there have been proposed liquid crystal spacer spraying apparatuses using a gas such as air, nitrogen gas and so on in place of chlorofluorocarbons. These liquid crystal spacer spraying apparatuses transport fine liquid crystal spacer particles together with a gas flow through a thin pipe (transportation pipe) and spray them onto a glass sheet by means of a swing nozzle. The liquid crystal spacer particles are a finely divided powder that has a particle size of about several microns and is liable to float. Further, since the liquid crystal spacer particles are composed of various plastic particles or silica particles, they are liable to be charged and it is difficult to spray them onto a glass sheet at a prescribed density with excellent reproducibility. To solve this problem, the glass sheet is charged to a polarity which is opposite to the polarity (electrostatic polarity) of the liquid crystal spacer particles being charged to permit the liquid crystal spacer particles to be uniformly sprayed onto the glass sheet at a given density with reliability.

As a method of improving the reliability and reproducibility when the liquid crystal spacer particles are sprayed onto a glass sheet as well as improving the accuracy of the density of them at which they are sprayed, there is employed a method of actively charging the liquid crystal spacer particles. However, a phenomenon of charging has relatively poor reproducibility and, in particular, even if it is intended to measure the amount of electric charge of a powder and a finely divided powder, the result of the measurement greatly fluctuates. Accordingly, this method has a limit in the improvement of reproducibility of spraying and accuracy of spraying density.

Another method intends to improve the reliability and reproducibility of spraying and the accuracy of spraying density by limiting the amount of electric charge of liquid crystal spacer particles only to the amount of electric charge which is inevitably generated by the collision of the spacer particles against the inner wall of a transportation pipe and making the amount of the thus generated electric charge constant by setting constant prescribed transporting and spraying conditions for the spacer particles. The applicant has put a liquid crystal spacer spraying apparatus "Model DISPA-$\mu$R" in market as a liquid crystal spacer spraying apparatus employing the above method.

The latter method of charging the liquid crystal spacer particles only passively to make the amount of the inevitably generated electric charge constant can permit the liquid crystal spacer particles to be sprayed at a prescribed spraying density at a pinpoint accuracy with excellent reproducibility, when the prescribed transporting condition is set within a transportation pipe for transporting the liquid crystal spacer particles and the prescribed spraying condition is set for the a spray nozzle. However, this method has a problem that the number of liquid crystal spacer particles which will be sprayed onto a glass substrate is varied, an intended spray cannot be executed and the liquid crystal spacer particles cannot be sprayed at all in an extreme case, when there is a change in the type of the liquid crystal spacer particles, the piping system such as the transportation pipe; the spray nozzle and so on, the type and state of a gas serving as a carrier medium and environmental conditions such as an atmosphere and so on or when any conditions change while the spacer particles are continuously sprayed.

An object of the present invention is to solve the problems of the prior art and provide a method and apparatus capable of controlling the amount of electric charge inevitably generated on the finely divided powder, even if there is a change in the type of the finely divided powder such as liquid crystal spacers and so on, a piping system such as a powder transportation pipe, the spray nozzle and so on, the type and state of a gas serving as a carrier medium and environmental conditions such as an atmosphere and so on as well as to provide a finely divided powder spraying method and apparatus capable of stably spraying the finely divided powder at a prescribed target spraying density with pinpoint accuracy having excellent reproducibility by controlling the amount of electric charge on the finely divided powder.

SUMMARY OF THE INVENTION

The inventors have completed the present invention by finding that the amount of electric charge, which is inevitably produced by friction on a finely divided powder such as liquid crystal spacers and so on when the liquid crystal spacers collide against the inner wall of a transportation pipe while they are transported therethrough, greatly affects the stability, reproducibility and accuracy of the liquid crystal spacers when they are sprayed and that the amount of frictional electric charge is affected by the state of a gas as a carrier medium of the liquid crystal spacers, in particular, by the dew-point of the gas, when the absolute water content per unit volume of the gas is very small, the amount of frictional electric charge linearly changes in accordance with the absolute water content of the gas, although it has been conceived that the gas contains a very small amount of water and does not substantially affect the amount of frictional electric charge.

According to a first aspect of the present invention, there is provided a method for controlling the amount of electric charge on a finely divided powder, comprising the step of, when the finely divided powder is supplied into a powder transportation pipe in a substantially discrete particle state, and transported therethrough in a discrete particle state by the stream of a compressed gas which has a very small water content whose dew-point is 0° C. or less, controlling the amount of electric charge on the finely divided powder, the electric charge being inevitably produced by friction on the finely divided powder by the collision thereof against the inner wall of the powder transportation pipe, by controlling the dew-point of the compressed gas.

It is preferable that the dew-point of the compressed gas be regulated by humidifying the compressed gas by causing it to pass through the inside of a pipe-shaped water penetrating film.

It is preferable that the dew-point of the gas be in the range of 0° C. to −70° C.

There is provided an apparatus for controlling the amount of electric charge on a finely divided powder, the apparatus comprising a gas supplying source; a dew-point controller for controlling the dew-point of the compressed gas supplied from the gas supplying source to a prescribed dew-point of 0° C. or less; a dew-point hygrometer for measuring the dew-point of the compressed gas having passed through the dew-point controller; a finely divided powder transportation pipe for transporting the finely divided powder in a discrete particle state by the stream of the compressed gas which has passed through the dew-point hygrometer and whose dew-point has been controlled; and a finely divided powder supplying device for supplying the finely divided powder into the finely divided powder transportation pipe in a substantially discrete particle state, wherein the amount of electric charge produced by friction on the finely divided powder by the collision thereof against the inner wall of the finely divided powder transportation pipe is controlled in accordance with the dew-point of the compressed gas.

It is preferable that the dew-point controller regulates the dew-point of the compressed gas supplied from the gas supplying source by humidifying the compressed gas by causing it to pass through the inside of a pipe-shaped water penetrating film.

It is preferable that finely divided powder supplying device comprises a hermetically-sealed pressure vessel filled with a preset amount of the finely divided powder and pressurized by the compressed air whose dew-point has been controlled; a grooved roll accommodated in the hermetically-sealed pressure vessel and having a groove formed around the outer circumferential surface thereof so as to be filled with the finely divided powder; and a pressure contact roll rotated in sliding contact with the grooved roll for filling the groove around the outer circumferential surface of the grooved roll with the finely divided powder, wherein the finely divided powder transportation pipe is extended into the hermetically-sealed pressure vessel and the inlet port of the finely divided powder transportation pipe is disposed in the proximity of the groove around the outer circumferential surface of the grooved roll.

According to a third aspect of the present invention, there is provided a finely divided powder spraying method, the method comprising the steps of controlling the dew-point of the compressed gas supplied from a gas supplying source having a very small water content to a preset dew-point of 0° C. or less; transporting the finely divided powder, which has been supplied into a finely divided powder transportation pipe in a substantially discrete state, therethrough in a discrete particle state by the compressed gas whose dew-point has been controlled; and uniformly spraying the finely divided powder onto a grounded sheet surface by a two-dimensional swinging nozzle in a discrete particle state, while controlling the amount of electric charge, which is produced by friction on the finely divided powder when the powder being transported collides against the inner wall of the finely divided powder transportation pipe, in accordance with the dew-point of the compressed gas.

According to a fourth aspect of the present invention, there is provided a finely divided powder spraying apparatus, the apparatus comprising a gas supplying source; a dew-point controller for controlling the dew-point of the compressed gas supplied from the gas supplying source and having a very small water content to a preset dew-point of 0° C. or less; a dew-point hygrometer for measuring the dew-point of the compressed gas having passed through the dew-point controller; a finely divided powder transportation pipe for transporting the finely divided powder in a discrete particle state by the stream of the compressed gas which has passed through the dew-point hygrometer and whose dew-point has been controlled; a finely divided powder supplying device for supplying the finely divided powder into the finely divided powder transportation pipe in a substantially discrete particle state; and a two-dimensionally swinging nozzle for uniformly spraying the finely divided powder, which is transported through the finely divided powder transportation pipe, onto a sheet surface which is charged to a polarity opposite to that of the finely divided powder in a discrete particle state, while controlling the amount of electric charge, which is produced by friction on the finely divided powder when the powder collides against the inner wall of the finely divided powder transportation pipe, by the dew-point of the compressed gas.

DESCRIPTION OF THE PREFERRED EMBODIMENT

A method and an apparatus for controlling the amount of electric charge on a finely divided powder and a finely divided powder spraying method and apparatus according to the present invention will be described in more detail based on a preferred embodiment shown in the accompanying drawings.

In the following description, the term "finely divided powder" and the term "powder" will be used in the same meaning.

Figure 1:
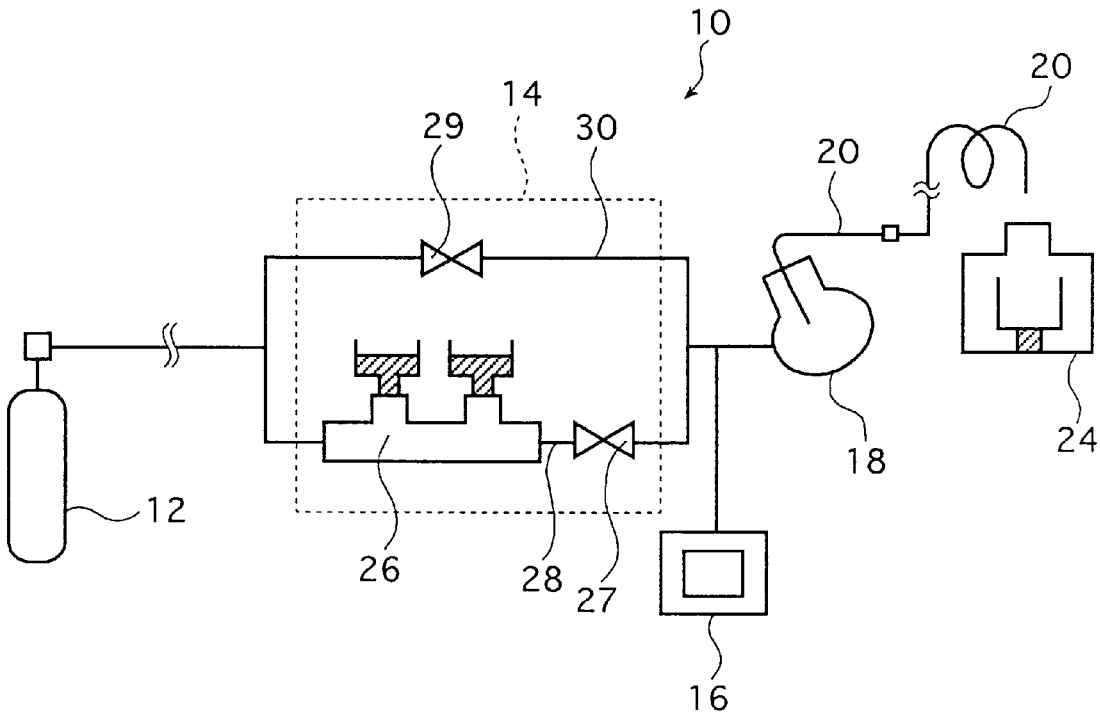
FIG. 1 is a view showing a schematic arrangement of an embodiment of an apparatus for controlling the amount of electric charge on a finely divided powder according to the present invention.

FIG. 1 is a view showing a schematic arrangement of an embodiment of an apparatus for controlling the amount of electric charge on a finely divided powder of the present invention for embodying a method of controlling the amount of electric charge on a finely divided powder of the present invention.

As shown in FIG. 1, the apparatus 10 for controlling the amount of electric charge on a finely divided powder (hereinafter, referred to as the amount of electric charge control apparatus 10) of the present invention includes a gas supply source 12 for supplying a gas serving as a carrier medium, a dew-point controller 14, a dew-point hygrometer 16, a powder supplying device 18 and a powder transportation pipe 20. In addition, the amount of electric charge control apparatus 10 shown in FIG. 1 is provided with a suction type Faraday gauge 24 disposed to the outlet of the transportation pipe 20 in order to measure the amount of electric charge on finely divided powder.

The finely divided powder handled in the present invention may be any type of finely divided powders so long as it is required to control the amount of electric charge thereof, and their type, size and shape are not particularly restricted. That is, the finely divided powder may be a powder which is passively charged by, for example, by friction inevitably caused when it collides against a transportation wall or a powder which is actively or forcibly charged by, for example, corona electrical charging. Liquid crystal spacer particles such as, for example, various plastic particles and silica particles, toner particles and powder paint particles are exemplified as the type of the finely divided powder. It is preferable that the particle size of the finely divided powder ranges from, for example, several microns to several tens of microns in diameter. In particular, the particle size of the liquid crystal spacers is preferably 1.0 to 10.0 $\mu$m. A ball shape, a spindle-shape and so on are exemplified as the shape of the finely divided powder. In the following description, the liquid crystal spacer particles (hereinafter, simply referred to as spacers) will be described as a typical finely divided powder to be handled by the present invention.

The gas supply source 12 supplies a compressed gas serving as a carrier medium for the finely divided powder such as the spacers. The carrier medium gas is not particularly restricted so long as it can transport the finely divided powder such as the spacers and an inert gas such as, for example, a nitrogen gas, argon and neon may be used in addition to air. Since the amount of electric charge on the finely divided powder is controlled by the dew-point of the compressed gas (the water content of the compressed gas), it is preferable that the compressed air contains water in an amount as small as possible. The gas supply source 12 is not particularly restricted so long as it can supply the above gases, and a compressor for supplying compressed air, a gas cylinder for containing various compressed gases and various liquefied gases such as liquid nitrogen are exemplified as the gas supply source 12. The compressed gas and the liquefied gas are sufficiently dehumidified in their manufacturing process and have a humidity near to zero. Although not shown, the gas supply source 12 is provided with a pressure regulator and a flow meter.

Figure 2:
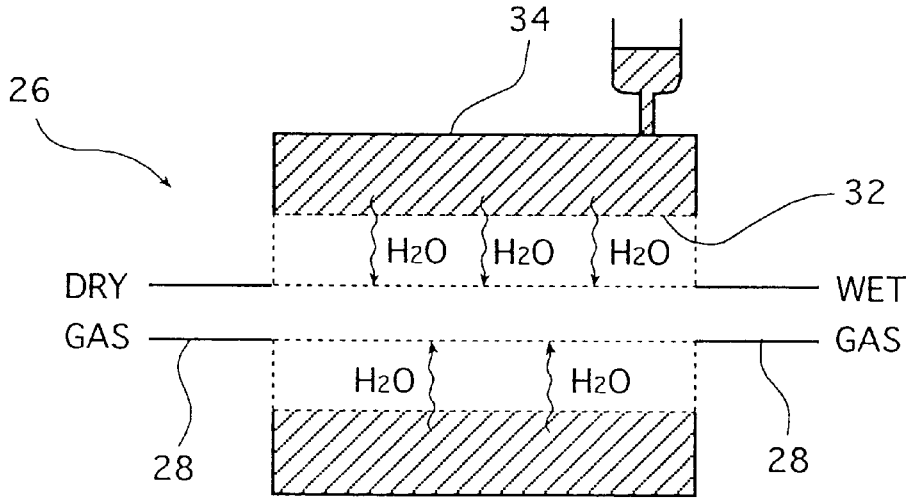
FIG. 2 is a view schematically describing an embodiment of a dew-point controller of the apparatus for controlling the amount of electric charge shown in FIG. 1.

The dew-point controller 14, which is the most characteristic portion of the present invention, controls the dew-point of the carrier medium gas, which is supplied from the gas supply source 12 and whose water content is substantially zero, to a prescribed range. The dew-point controller 14 is provided with a water adding line 28 and a bypass line 30. The water adding line 28 includes a water adding unit 26 for increasing the water content of the carrier medium gas (hereinafter, also referred to as a dry gas) supplied from the gas supply source 12 by a trace amount and a flow regulating valve 27 for regulating the flow rate of the carrier medium gas whose water content is increased (hereinafter, also referred to as a wet gas). The bypass line 30 includes a flow regulating valve 29 for controlling the flow rate of the dry gas that bypasses the water adding line 28. The water adding unit 26 adds a trace amount of water to the dry gas, that is, humidifies the dry gas and makes it into a wet gas by passing the dry gas through the interior of a pipe-shaped water penetrating film. As schematically shown in FIG. 2, the water adding unit 26 includes a hollow-thread film 32 through which the dry gas passes and a casing 34 disposed to the outside of the hollow-thread film 32 for reserving water. With this arrangement, vapors penetrate the gas in the interior of the hollow-thread film 32 from the outside thereof by the difference of the partial pressures of the vapors so that the dry gas is slightly humidified, that is, a trace amount of water is added to the dry air. That is, one of the features of the present invention resides in that the hollow-thread film, which is conventionally used to filtrate a liquid by penetrating water molecules therethrough and removing impurities which are mixed with the liquid and larger than the water molecules, is used to add water to the gas passing through the interior of the hollow-thread film by penetrating the water to the film from the outside thereof.

The dew-point controller 14 regulates the flow rate of the dry gas which will flow through the water adding line 28 and the bypass line 30 by controlling the flow regulating valves 27 and 29, respectively. The dry gas as the carrier medium gas from the gas supply source 12 is separately supplied to the water adding line 28 and the bypass line 30 which are divided into two portions. The dry gas, which is supplied to the water adding line 28, passes through the interior of the hollow-thread film 32 of the water adding unit 26. At the time, the dry gas is mixed with the water in the casing 34 which penetrates from the outside of the hollow-thread film 32 to the interior thereof and thereby making the wet gas whose water content is regulated. With this operation, the flow rate of the wet gas containing a prescribed amount of water is regulated by the flow regulating valve 27. Accordingly, the flow rate of the dry gas which flows through the water adding line 28 is also regulated by the flow regulating valve 27, and, the dry gas which flows through the bypass line 30 bypasses the water adding unit 26 and the flow rate thereof is regulated by the flow regulating valve 29.

As described above, the wet gas in the water adding line 28 whose flow rate is regulated by the flow regulating valve 27 is mixed with the dry gas in the bypass line 30 whose flow rate is regulated by the flow regulating valve 29 so that a mixed gas (dew-point regulated gas) whose water content is regulated to a prescribed amount, that is, whose dew-point is regulated to a prescribed value is produced. The dew-point of the carrier medium gas which will be supplied to the powder supplying device 18 is controlled as described above.

In the dew-point controller 14 of the present invention, the dew-point of the carrier medium gas, that is, the water content thereof is controlled by the two steps; the step of adding the water to the gas by the hollow-thread film 32 in the water adding line 28; and the step of regulating the mixed amount of the wet gas in the water adding line 28, to which the prescribed amount of water is added, and the dry gas in the bypass line 30 by the flow regulating valves 27 and 29. This is for the purpose of accurately regulating the water content and accordingly the dew-point, because it is difficult to minutely control the water content (dew-point) only by the regulation of the water added through the hollow-thread film 32.

The hollow-thread film 32 may be any pipe-shaped water penetrating film so long as it can add a trace amount of water to the dry gas, and a hollow-thread film made of fluororesin is exemplified.

The illustrated dew-point controller 14 adds water to the gas supplied from the gas supply source 12 using the water adding unit 26 to thereby regulate the dew-point (water content). However, the present invention is not restricted thereto and the dew-point (water content) may be controlled by removing water from the supplied gas and regulating the mixed amount of the water-removed gas and a gas from which no water is removed. In this case, such an arrangement may be employed that a dry gas having a very low dew-point (very low water content) is passed around the outside of the hollow-thread film 32 and the water contained in the supplied gas flowing in the interior of the hollow-thread film 32 is penetrated toward the outside of the hollow-thread film 32.

Figure 4:
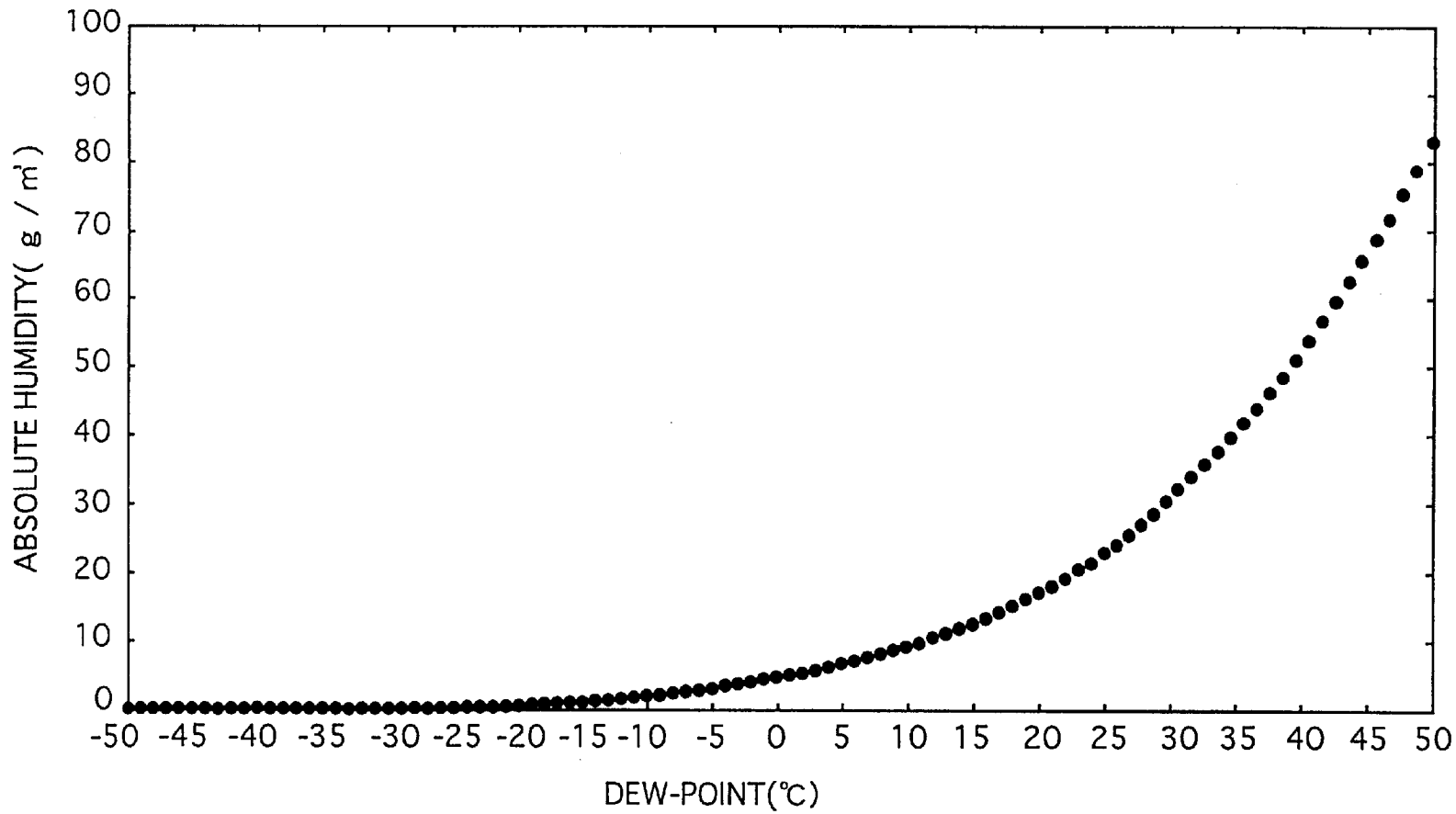
FIG. 4 is a graph showing the relationship between water content of a gas and a dew-point thereof.

The term "dew-point of a gas" used here is the temperature at which the partial pressure of the vapor in the gas becomes equal to the saturated vapor pressure thereof. This temperature is equal to the temperature at which vapor condensation is observed when the temperature of a gas containing vapors is successively lowered. Therefore, the dew-point of a gas represents an absolute water content under a given pressure. FIG. 4 shows the relationship between a dew-point of a gas and a humidity under atmospheric pressure and Table 1 shows the relationship between a dew-point of a gas, a water content thereof and a relative humidity of the gas at 25° C.

TABLE 1

Relative humidity and water content of gas at 25° C. determined from dew-point

| | Relative humidity at 25° C. | Water content g/Nm$^3$ |
|---|---|---|
| Gas with dew-point of −10.0° C. | 8.2% RH | 2.14 g/Nm$^3$ |
| Gas with dew-point of −30.0° C. | 1.2% RH | 0.339 g/Nm$^3$ |
| Gas with dew-point of −50.0° C. | 0.12% RH | 0.0382 g/Nm$^3$ |

The range of the dew-point of a gas for regulating the amount of electric charge on the finely divided powder in the present invention may be any range in which the amount of electric charge on the finely divided powder can be controlled by the dew-point of the gas and may preferably be any range in which the amount of electric charge and the dew-point have a linear relationship. Accordingly, although the range of the dew-point may be suitably selected in accordance with a type of the gas and a type and a size of the finely divided powder and the like, a low humidity range such as a range in which the dew-point is 0° C. or less is particularly effective. For example, the dew-point is controlled to 0° C. or less, preferably 0 to −70° C. and more preferably −20° C. to −60° C.

The dew-point hygrometer 16 measures the dew-point of the carrier medium gas whose dew-point is regulated by the dew-point controller 14, and a dew-point humidity meter, a dew-point recorder and so on are exemplified. The present invention may use a Lambrecht dew-point hygrometer which visually detects a dew-point with a naked eye by observing the frosted state of a mirror-finished metal surface, or the like. It is preferable, however, to use an automatic dew-point hygrometer such as, for example, an alumina oxide sensor type dew-point hygrometer which can automatically measure and record a dew-point using air resistance or light reflection to successively measure and record the dew-point, when an amount of electric charge is controlled or a spraying operation is controlled by controlling the amount of electric charge and in particular when they are automatically controlled.

In the present invention, the flow regulating valves 27 and 29 are controlled so that the dew-point, which is to be measured by the dew-point hygrometer 16, of the dew-point-regulated mixed gas has a prescribed value and, more accurately, is located within a prescribed range. When, for example, the dew-point measured by the dew-point hygrometer 16 is lower than the prescribed value (a water content is small), the degree of opening of the flow regulating valve 27 is increased to increase the flow rate of the wet gas and the degree of opening of the flow regulating valve 29 is reduced to reduce the flow rate of the bypassed dry gas. Whereas, when the dew-point is higher than the prescribed value (when the water content is large), an opposite operation is executed. When the flow regulating valves 27 and 29 are adjusted once to regulate the dew-point, they need not be adjusted at all times because the dew-point changes only slightly. Thus, the flow regulating valves 27 and 29 may be manually controlled, respectively. However, it is also possible to compose the flow regulating valves 27 and 29 of automatic valves such as electromagnetic valves, to manually or automatically input a measured dew-point to a not shown automatic controller and, in particular, to automatically feedback an automatically measured dew-point to the automatic controller and to automatically control the flow regulating valves 27 and 29 by the automatic controller.

Figure 3:
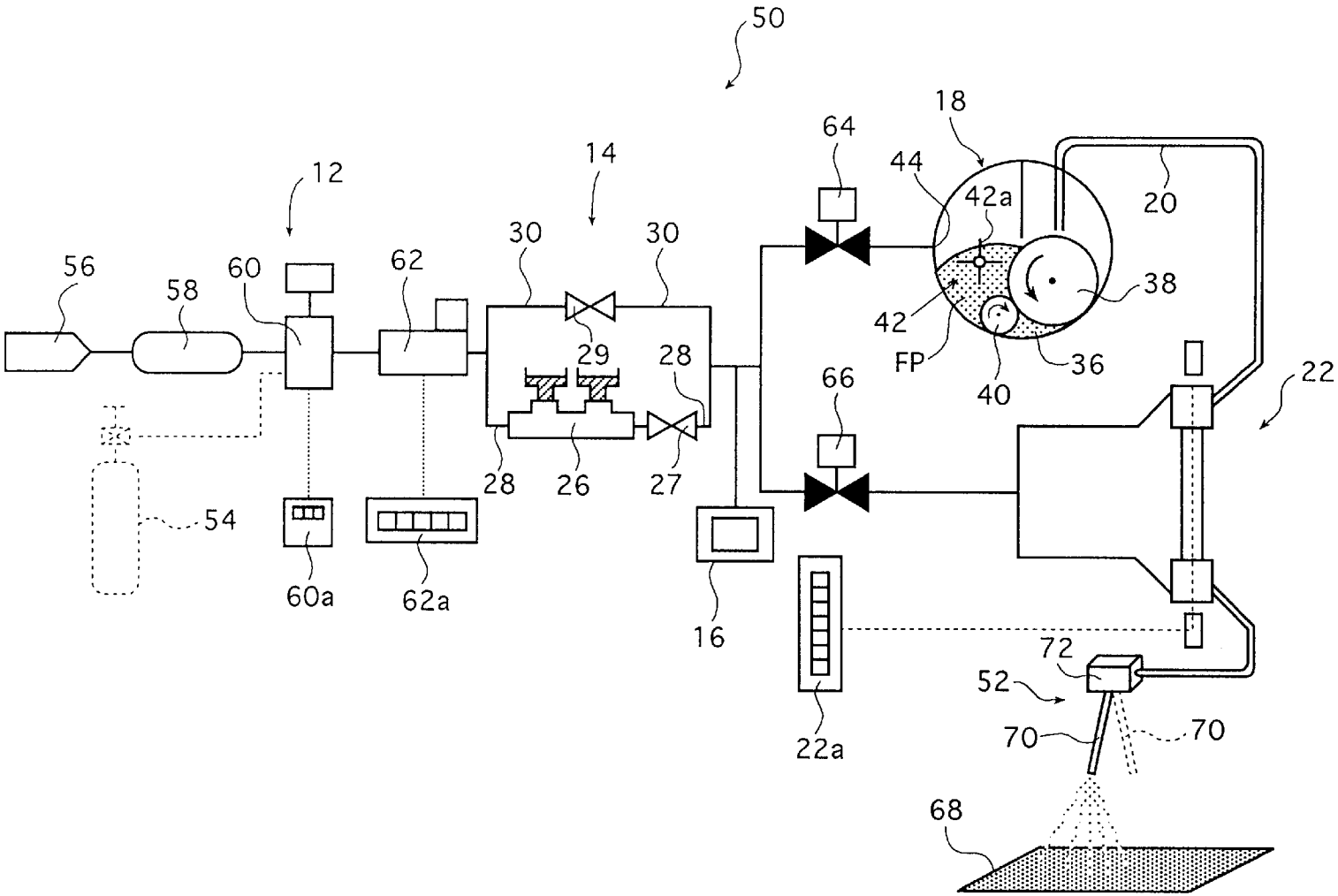
FIG. 3 is a view showing a schematic arrangement of an embodiment of a finely divided powder spraying apparatus according to the present invention.

The powder supplying device 18 supplies the finely divided powder (liquid crystal spacers) filled in the groove of a grooved roll 38 to the transportation pipe 20 in a discrete particle state, a state near to the discrete particle state or a state in which several particles are condensed (hereinafter, these three states are referred to as a substantially discrete state as a whole), in a state that the interior of the powder supplying device 18 is pressurized by the carrier medium gas having a dew-point which is measured by the dew-point hygrometer 16 and controlled within the prescribed range. As shown in FIG. 3, the powder supplying device 18 includes a substantially hermetically sealed pressure vessel 36 having an interior which is pressurized by the dew-point-controlled gas and filled with a prescribed amount of the finely divided powder FP, the grooved roll 38 which is rotated in the pressure vessel 36 and has the groove which is formed around the outer circumferential surface thereof and filled with the finely divided powder FP in the substantially discrete state, a pressure contact roll 40 for forcibly placing the finely divided powder FP into the groove of the grooved roll 38 in the substantially discrete particle state, a stirrer 42 having stirring blades 42*a* for stirring the finely divided powder FP and a gas introduction port 44 disposed in the pressure vessel 36 for introducing the dew-point-controlled gas.

The powder transportation pipe 20 is inserted above the groove (not shown) around the outer circumferential surface of the grooved roll 38 in the pressure vessel 36 from the outside thereof and extended with an extreme end (one of the ends) thereof serving as an inlet located in the very proximity of the outer circumferential surface of the grooved roll 38. A reason why the inlet of the extreme end of the transportation pipe 20 is disposed in the proximity of the groove of the grooved roll 38 is to permit the finely divided powder filled in the groove to be successively supplied to the transportation pipe 20 by the rotation of the grooved roll 38 in a state as they are or in a state that they are dispersed and made to the substantially discrete molecular state, as the pressurized carrier medium gas is sucked into the inlet of the transportation pipe 20.

The transportation pipe 20, which transports the finely divided powder FP supplied from the powder supplying device 18 in the substantially discrete molecule state together with the stream of the pressurized carrier medium gas sucked thereinto, has an inside diameter of 0.5–20 mm, preferably has an inside diameter of 1–4 mm and an outside diameter of 2–6 mm and more preferably has an inside diameter of 3 mm and an outside diameter of 4 mm to an inside diameter of 4 mm and an outside diameter of 6 mm. The length of the transportation pipe 20 is 0.1–10 m and preferably about 2–4 m. The transportation pipe 20 is composed of a metal pipe such as, for example, a stainless pipe of SUS 316, SUS 304 or the like, a rubber pipe such as a silicon rubber pipe, a resin pipe such as a Teflon pipe, a metal pipe whose inner wall is coated with rubber such as silicon rubber or resin such as Teflon or the like.

The flow rate of the carrier medium gas in the transportation pipe 20 is not particularly restricted and may be suitably determined in accordance with the amount of sprayed finely divided powder (per unit volume), the flow rate of the finely divided powder, the gas pressure in the powder supplying device 18 and the inside diameter and length of the transportation pipe 20. It is, for example, 5–500 l/min, and when the spacers are to be transported, it is preferably about 20–120 l/min. Further, the gas velocity in the transportation pipe 20 is also not particularly restricted and may be suitably set in accordance with the amount of the sprayed finely divided powder, the flow rate of the finely divided powder, the gas pressure in the powder supplying device 18 and the inside diameter and length of the transportation pipe 20 as described above. It is, for example, 10–200 m/sec, and when the spacers are to be transported, it is preferably about 20–160 m/sec.

In addition, the shape of the transportation pipe 20 is not particularly restricted and may be a straight pipe, a loop pipe or a coil pipe wound to a coil state.

The finely divided powder FP is not actively charged in the present invention. However, when the finely divided powder FP is transported through the transportation pipe 20, it collides against the inside wall of the transportation pipe 20 at random and is inevitably charged by friction. When it is assumed that the conditions of the finely divided powder, the transportation pipe 20 and so on are the same, it can be said that the amount of electric charge on the finely divided powder, which is inevitably caused to the powder by friction in the transportation pipe 20 until the powder is discharged therefrom, changes in correspondence to the dew-point of the carrier medium gas and is approximately proportional to the dew-point in many cases. Thus, the amount of electric charge can be approximated by a linear function. When the relationship between the dew-point and the amount of electric charge on the finely divided powder is previously determined as to each of the prescribed combinations of various types of the spacers and various types of the transportation pipe 20, and the dew-point of the gas is controlled to the prescribed value or within the prescribed range while measuring the dew-point of the gas by the dew-point hygrometer 16, the amount of electric charge on the finely divided powder discharged from the transportation pipe 20 can be controlled to a prescribed value or within a prescribed range in accordance with the previously determined relationship.

In the example shown in FIG. 1, the amount of electric charge on the finely divided powder discharged from the transportation pipe 20 is measured with the suction type Faraday gauge 24. The Faraday gauge 24 is composed of a vessel formed by combining two pail-shaped metal vessels which are insulated from each other and a filter is attached to the bottom of the inner vessel of the Faraday gauge 24. When the finely divided powder being charged is sucked into the inner vessel by a suction pump and reserved therein, the amount of electric charge of the finely divided powder as a whole can be determined by measuring the difference of the electric potentials between the inner vessel and the outer vessel. Further, when the weight of the entire finely divided powder is measured, the amount of electric charge on a unit weight of the finely divided powder can be calculated. Although the amount of electric charge on the finely divided powder is measured with the Faraday gauge 24 using a Faraday gauge method in the illustrated example, a method of measuring the amount of electric charge from the amount of electric charge of a loop pipe itself may be used.

The amount of electric charge control apparatus 10 of the present invention is fundamentally arranged as described above. Next, the operation of the apparatus 10 and a method of controlling the amount of electric charge on the finely divided powder (hereinafter, referred to as the amount of electric charge control method) of the present invention will be described below in detail.

In the amount of electric charge control method of the present invention, first, the dew-point of the pressurized gas supplied from the gas supply source 12 is controlled to a prescribed value with respect to a prescribed combination of the finely divided powder and the transportation pipe 20 by the dew-point hygrometer 16 and the dew-point controller 14 and the pressurized gas having the dew-point restricted to the prescribed value is supplied to the powder supplying device 18. In the powder supplying device 18, the finely divided powder that is filled in the groove of the grooved roll 38 in the substantially discrete particle state by the pressure contact roll 40 is sucked from the inlet at the extreme end of the transportation pipe 20 disposed in the proximity of the groove and supplied into the transportation pipe 20 in the substantially discrete particle state.

The finely divided powder supplied into the transportation pipe 20 is transported therethrough together with the dew-point-regulated gas serving as the carrier medium. At this time, the finely divided powder collides against the inside wall and so on of the transportation pipe 20 and inevitably causes friction thereagainst while it is transported as well as when is separated to the discrete molecule state and dispersed. Thereafter, the thus charged finely divided powder which has been properly separated and dispersed to the discrete molecule state is discharged from the outlet which is located at the trailing end of the transportation pipe 20, sucked into the Faraday gauge 24 and collected there so that the amount of electric charge on the finely divided powder as a whole is measured. When the weight of the charged finely divided powder, which is collected as described above, is also measured at the time of the above measurement or after or before the measurement, the amount of electric charge on a unit weight of the finely divided powder or the amount of electric charge on one particle thereof is calculated and determined. Accordingly, the amount of electric charge on the finely divided powder at the prescribed dew-point of the gas is measured as described above.

When the amount of electric charge on the finely divided powder is measured while changing the dew-point of the carrier medium gas by the dew-point controller 14, the relationship between the dew-point of the gas and the amount of electric charge on the finely divided powder is determined by measurement as to several dew-points of the gas. As a result, the relationship between the dew-point of the gas and the amount of electric charge on the finely divided powder can be determined as to the specific combination of the finely divided powder and the transportation pipe 20.

The amount of electric charge on the finely divided powder, which is inevitably charged in the transportation pipe 20, can be controlled to the prescribed value by controlling the dew-point of the gas to the prescribed value by the dew-point hygrometer 16 and the dew-point controller 14 based on the relationship between the dew-point of the gas and the amount of electric charge on the finely divided powder at the specific combination which is determined previously as described above.

The amount of electric charge on the finely divided powder may be controlled to the prescribed value by previously determining the relationship between the dew-point of the gas and the amount of electric charge on the finely divided powder likewise as to a plurality of different specific combinations of the finely divided powder and the transportation pipe 20 in addition to the one combination thereof and likewise controlling the dew-point to the prescribed value based on the thus determined relationship.

The amount of electric charge control method of the present invention is fundamentally arranged as described above.

Next, the finely divided powder spraying method and apparatus of the present invention will be described below in detail.

FIG. 3 is a view showing a schematic arrangement of an embodiment of the finely divided powder spraying apparatus according to the present invention for embodying the finely divided powder spray method of the present invention.

As shown in the drawing, the finely divided powder spraying apparatus 50 of the present invention includes a gas supply source 12 for supplying a gas serving as a carrier medium, a dew-point controller 14, a powder supplying device 18, a powder transportation pipe 20, a laser type densitometer 22 and a swing nozzle 52. Although the finely divided powder spraying apparatus 50 has the same arrangement as that of the amount of electric charge control apparatus 10 shown in FIG. 1 except the swing nozzle 52, the former apparatus 50 is different from latter apparatus 10 in that it specifically exemplifies the several elements in latter apparatus 10.

Accordingly, the same numerals as used in FIG. 1 are used to denote the same components in FIG. 3 and the detailed description thereof is omitted.

A gas container 54 for a compressed gas, liquefied gas and so on may be used as the gas supply source 12 as described above. Otherwise, a compressor 56 for producing a compressed gas such as compressed air by compressing a gas such as the air and an accumulator 58 for temporarily reserving the compressed gas produced by the compressor 56 may be used. In the gas supply source 12, the gas, which flows downstream from the gas container 54 or the accumulator 58 enters a regulator 60 so that its pressure is reduced and regulated to a prescribed pressure. A pressure indicator 60*a* displays the regulated pressure. At the time, the regulation of the gas pressure to the prescribed pressure by the regulator 60 causes the flow rate of the gas to be also regulated to a prescribed flow rate. A flow meter 62 located downstream measures the flow rate of the gas and a flow indicator 62*a* displays the measured flow rate.

The dew-point of the gas, whose pressure has been regulated and whose flow rate has been measured, is regulated to a desired dew-point by the dew-point controller 14 and measured by a dew-point hygrometer 16 as described above.

The pressurized gas whose dew-point has been regulated and measured is divided into two gas portions. One of the gas portions is supplied to the powder supplying device 18 through a flow regulating valve 64, whereas the other gas portion is supplied to the laser type densitometer 22 through a flow regulating valve 66. The flow regulating valves 64 and 66 are emergency valves which will be manually opened and closed to promptly prevent the dangerous state of the apparatus when there is a possibility that the apparatus is made dangerous or when the apparatus will be dangerous by its abnormal operation.

As described above, the dew-point-regulated pressurized gas supplied to the powder supplying device 18 is sucked into the transportation pipe 20 together with finely divided powder in a substantially discrete particle state in the powder supplying device 18. The finely divided powder which is transported through the transportation pipe 20 in the discrete molecule state collides against the inner wall of the pipe 20 and comes into contact therewith so that it is inevitably charged by friction as described above. The thus transported finely divided powder enters the laser type densitometer 22 at some midpoint in the transportation pipe 20.

The densitometer 22 measures the concentration of the finely divided powder which is being transported through the transportation pipe 20 and a concentration indicator 22*a* displays the measured concentration so that whether the finely divided powder is condensed or in the discrete particle state is monitored. Although the densitometer 22 may be any densitometer so long as it can measure the amount of the finely divided powder flowing through the transportation pipe 20 downstream, it is composed of a laser serving as a light source and a light receiving element for receiving the laser beam from the laser in the example shown in the drawing and measures the concentration of the finely divided powder and, in particular, monitors whether the finely divided powder is condensed or not by measuring the degree of transmission of the laser beam passing through a glass tube in which the finely divided powder flows downstream.

Although the concentration of the finely divided powder transported through the transportation pipe 20 together with the gas is measured with the laser type densitometer 22 in the illustrated example, the present invention is not limited thereto and any type of a densitometer may be used so long as it does not greatly change the transporting state in the transportation pipe 20. For example, a densitometer of a type which detects the charge caused by the friction of the spacers against the pipe may be employed. Although the laser type densitometer 22 is disposed at some midpoint in the transportation pipe 20 for measuring and monitoring the concentration of the finely divided powder as shown in the illustrated example, the densitometer 22 need not be provided when it is previously confirmed that the finely divided powder is properly separated to the discrete molecule state and dispersed.

The finely divided powder whose proper concentration has been measured with the laser type densitometer 22 is supplied to the swing nozzle 52 together with the gas.

The swing nozzle 52 uniformly sprays the finely divided powder FP onto the glass sheet 68, which is grounded, of a liquid crystal substrate at a prescribed spray density. The swing nozzle 52 includes a nozzle pipe 70 for discharging the finely divided powder FP from an extreme end and a drive unit 72 for two-dimensionally swinging the nozzle pipe 70 above the glass sheet 68. The swing nozzle 52 is disposed on the upper surface of a spray tank (not shown) as a unit, two-dimensionally swings in a polyvinyl chloride tank (not shown) disposed in the spray tank and sprays the finely divided powder FGP onto the grounded glass sheet 68. Although the charging polarity of the finely divided powder is determined by the combination of the finely divided powder FP and the transportation pipe 20 as described above, the finely divided powder can be effectively adhered to the glass sheet 68 and uniformly sprayed in a strictly controlled amount without being adhered to the inner wall of the polyvinyl chloride tank by charging the inner wall thereof to the same polarity. Although the glass sheet 68 is grounded in the present invention, it may be charged to a polarity opposite to that of the finely divided powder FP.

The finely divided powder spraying apparatus of the present invention is fundamentally arranged as described above. Next, the operation of the spraying apparatus and the finely divided powder spraying method of the present invention will be described below.

In the spraying apparatus 50 of the present invention, after the compressed gas compressed by the compressor 56 of the gas supply source 12 is reserved in the accumulator 58, the compressed gas is directly supplied from the accumulator 58 or the gas container 54 such as a gas cylinder, and the pressure thereof is reduced to a desired pressure by the regulator 60. The reduced pressure of the compressed gas is displayed on the pressure indicator 60*a*, a desired flow rate thereof is measured by the flow meter 62 and displayed on the flow indicator 62*a* and thereafter the compressed gas is supplied to the dew-point controller 14.

The dew-point controller 14 controls the dew-point of the compressed gas by the same method as the aforesaid amount of electric charge control method so that the finely divided powder has a desired amount of electric charge, and the dew-point is measured by the dew-point hygrometer 16. Subsequently, the compressed gas whose dew-point has been measured is divided into two gas portions and the respective flow rates thereof are regulated by the flow regulating valves 64 and 66. The compressed gas whose flow rate has been regulated by the flow regulating valve 64 is supplied to the powder supplying device 18 as described above. The powder supplying device 18 causes the finely divided powder to be sucked into the transportation pipe 20 in the substantially discrete particle state together with the compressed gas as described above.

The thus sucked finely divided powder is transported through the transportation pipe 20 by the compressed gas in the discrete particle state, repeatedly collides against the inner wall of the transportation pipe 20 so that it is inevitably charged by friction. Since the dew-point of the compressed gas for transporting the finely divided powder through the transportation pipe 20 is controlled to the prescribed dew-point by the aforesaid amount of electric charge control method, the amount of electric charge on the finely divided powder is controlled to a prescribed amount of electric charge. The concentration of the finely divided powder is monitored by the laser type densitometer 22 at some mid-point in the transportation pipe 20 and displayed on the concentration indicator 22*a*. That is, the concentration of the finely divided powder which is transported through the transportation pipe 20 is measured by the laser type densitometer 22 so that whether the finely divided powder is condensed or not is measured.

When the finely divided powder is not condensed (the concentration thereof measured by the laser type densitometer 22 is not high) and has a proper concentration, the finely divided powder which is transported through the transportation pipe 20 in the discrete particle state by the compressed gas is a uniform finely divided powder having a constant or substantially constant amount of electric charge. Therefore, the finely divided powder can be uniformly sprayed onto the glass sheet 68 by the swing nozzle 52 in a strictly controlled amount. In the swing nozzle 52, the discharge port which is located at the extreme end of the nozzle pipe 70 is swung in an X-direction by the X-driver (not shown) of the drive unit 72 and at the same time slid in a Y-direction by the Y-driver (not shown) thereof. Since the nozzle pipe 70 scans the glass sheet 68 uniformly and two-dimensionally as well as discharges the finely divided powder FP from the discharge port in a prescribed concentration (at prescribed intervals), the finely divided powder FP can be uniformly sprayed onto the glass sheet 68 in a prescribed spray density in the strictly controlled amount.

The present invention will be specifically described based on an embodiment.

Figure 5:
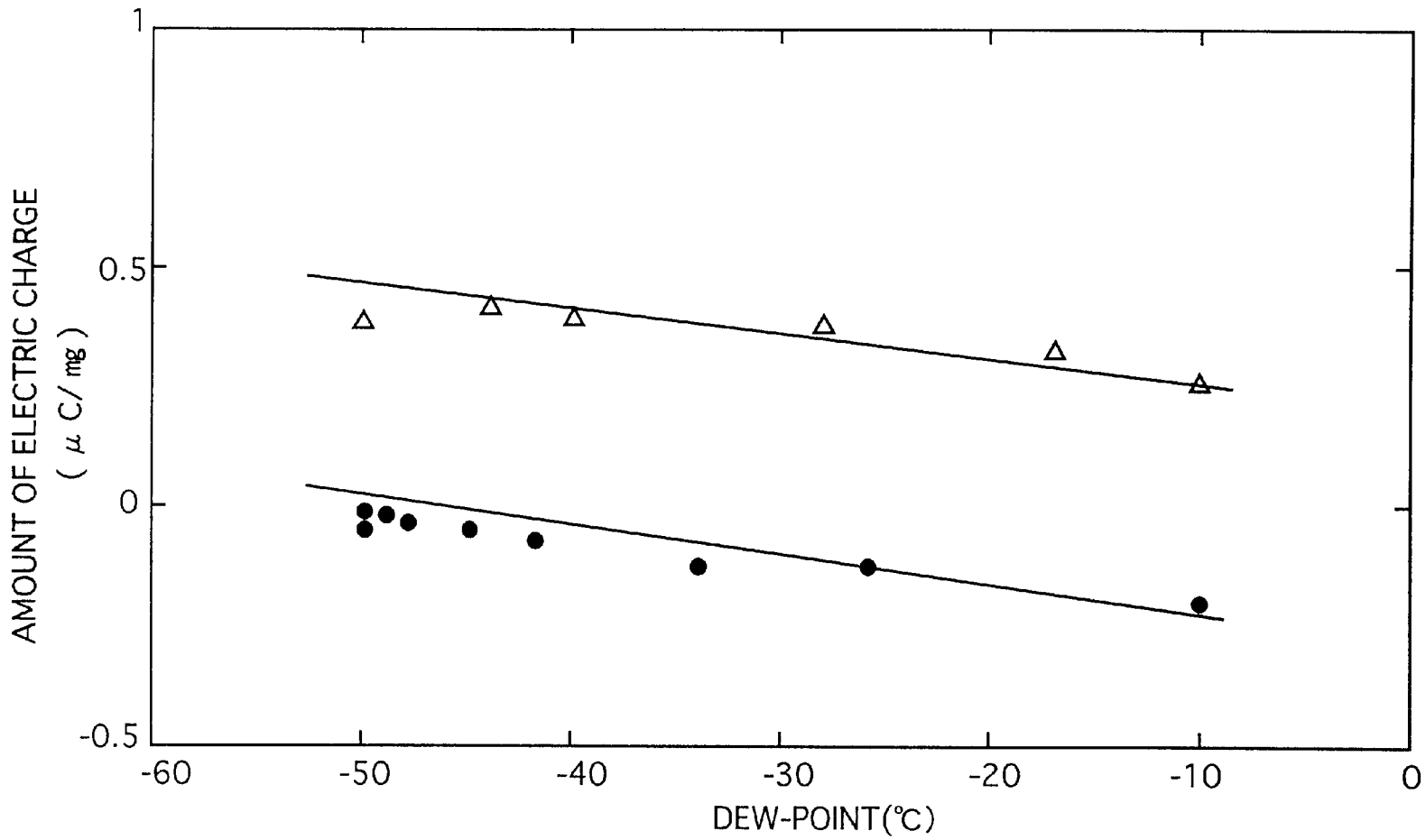
FIG. 5 is a graph showing an example of the relationship between the dew-point of a gas and the amount of electric charge of a finely divided powder in the embodiment.
Figure 6:
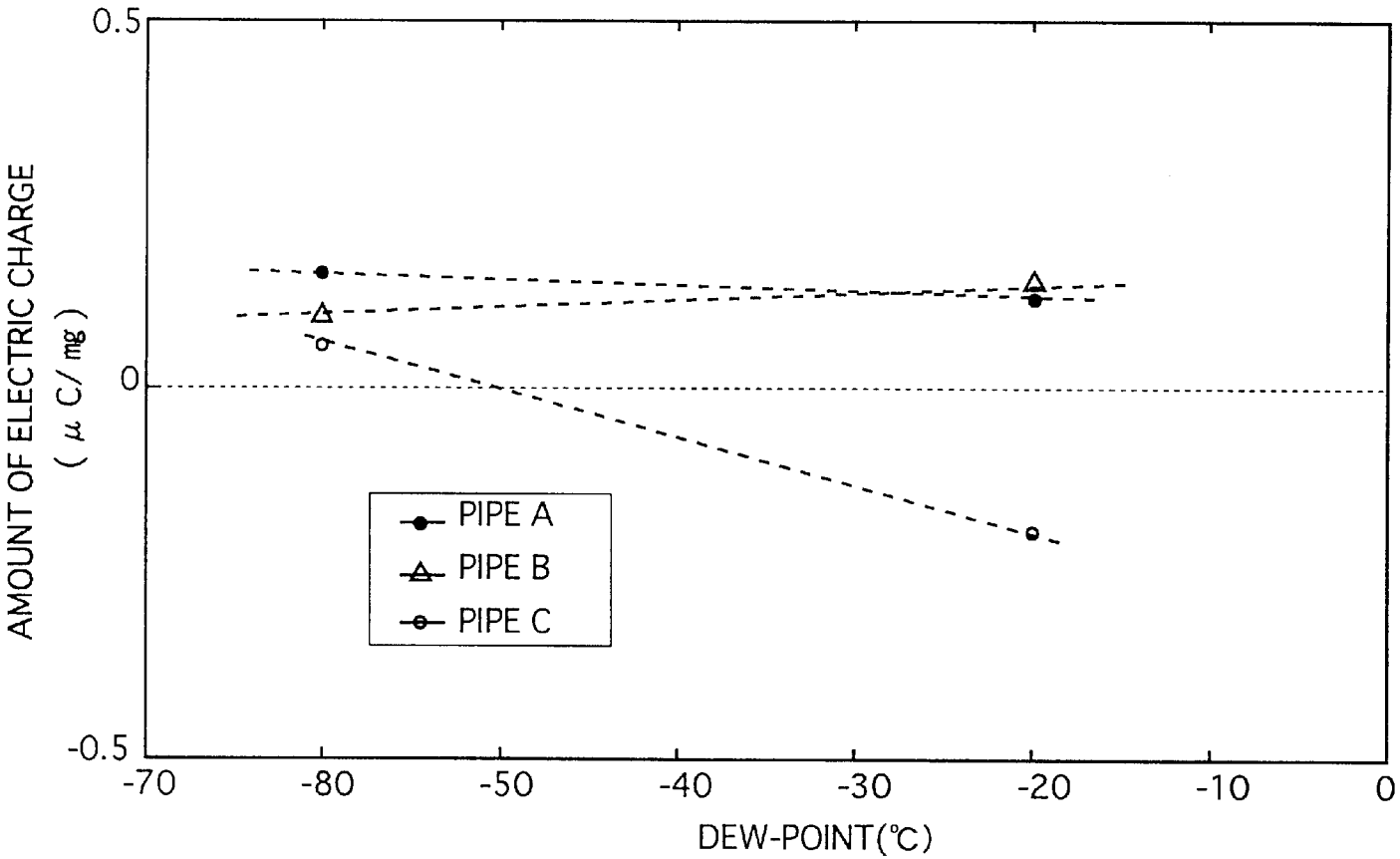
FIG. 6 is a graph showing another example of the relationship between the dew-point of the gas and the amount of electric charge on the finely divided powder in the embodiment.

Various plastic spacers were sprayed in a combination of a specific type of the liquid crystal spacers and a specific type of the transportation pipe 20 using the amount of electric charge control apparatus 10 shown in FIG. 1 and the finely divided powder spraying apparatus 50 shown in FIG. 3 under the following conditions. That is, particle size of the spacers: 1–10 $\mu$m, flow rate of the gas in the transportation pipe 20: 20–120 l/min, velocity of the gas in the transportation pipe 20: 20–160 m/sec, diameter of the transportation pipe 20 (outside diameter x inside diameter): 4×3 mm to 6×4 mm, length of the transportation pipe 20: 2–4 m, type of the gas: nitrogen gas ($N_2$) and air, and number (density) of the spacers sprayed onto the glass sheet: 10–2000 pieces/mm$^2$. In the above spraying process, the amount of electric charge on the spacers was measured with the Faraday gauge 24 at every prescribed time of spray. FIG. 5 and FIG. 6 show the result of the measurement.

In FIG. 5, plastic spacers were used as the liquid crystal spacers, $N_2$ (nitrogen) gas was used as the carrier gas and two types of stainless steel (SUS) pipes were used as the transportation pipe 20. The amount of electric charge on the plastic spacers was measured as to each of the stainless steel pipes by changing the dew-point of the nitrogen gas. FIG. 5 shows the relationship between a dew-point of the nitrogen gas and an amount of electric charge on the plastic spacers. In the above measurement, the conditions other than those specified here are the same as those described above.

As shown in FIG. 5, it can be found that a decrease of the dew-point of the carrier gas increases the amount of electric charge regardless of polarity and a linear relationship (proportional relationship) is established between the dew-point of the gas and the amount of electric charge of the finely divided powder.

In FIG. 6, the same gas as that used in FIG. 5 and the same liquid crystal spacers as those used in FIG. 5 were used and further materials different from those used in FIG. 5 were used for the transportation pipe 20 and the relationship between a dew-point of the gas and an amount of electric charge of the liquid crystal spacers was measured. FIG. 6 shows the result of the measurement.

As shown in FIG. 6, it can be found that there is established a linear relationship between the dew-point of the gas and the amount of electric charge on the liquid crystal spacers likewise the case shown in FIG. 5, although the amount of electric charge is different depending upon the materials of the transportation pipe.

The method and apparatus for controlling the amount of electric charge on a finely divided powder and the finely divided powder spraying method and apparatus according to the present invention are fundamentally arranged as described above. However, the present invention is by no means limited thereto and it goes without saying that various improvements and design modifications can be made within the scope which does not depart from the gist of the present invention.

As described above in detail, according to the method and apparatus for controlling the amount of electric charge on a finely divided powder of the present invention, the amount of electric charge on the finely divided powder, which is inevitably generated thereto by friction when the powder collides against the inner wall of the powder transportation pipe, can be stably controlled to a strictly controlled amount at a pinpoint accuracy with excellent reproducibility by controlling the dew-point of a compressed gas serving as the carrier medium of the powder to a desired value.

Further, according to the finely divided powder spraying method and apparatus of the present invention, the finely divided powder can be stably sprayed onto a sheet surface such as a liquid crystal glass substrate in a discrete particle state to a strictly controlled amount at a pinpoint accuracy with excellent reproducibility, even if the sprayed powder has a very low density, by controlling the amount of electric charge inevitably produced on the powder which is transported through the powder transportation pipe to a desired value by controlling the dew-point of the powder.

What is claimed is:

1. A method for controlling an amount of electric charge on a finely divided powder, comprising the steps of:

supplying the finely divided powder in a substantially discrete particle state into a transportation pipe;

transporting the finely divided powder through the powder transportation pipe by using a stream of a compressed gas having a dew-point of 0° C. or less; and controlling the amount of electric charge on the finely divided powder by regulating the dew point of the compressed gas, the electric charge being produced by friction on the finely divided powder by the collision thereof against an inner wall of the transportation pipe.

2. The method for controlling the amount of electric charge on the finely divided powder according to claim 1, wherein the dew-point of the compressed gas is regulated by humidifying the compressed gas by causing said compressed gas to pass through a dew-point controller comprising a water-adding unit having a pipe-shaped water penetrating hollow-thread film.

3. The method for controlling the amount of electric charge on the finely divided powder according to claim 1, wherein the dew-point of the compressed gas is regulated within the range of 0° C. to −70° C.

4. The method for controlling the amount of electric charge on the finely divided powder according to claim 1, wherein the dew-point of the compressed gas is regulated within the range of −20° C. to −60° C.

5. A finely divided powder spraying method, comprising the steps of:

supplying the finely divided powder in a substantially discrete particle state into a transportation pipe;

controlling the dew-point of a compressed gas supplied from a gas-supplying source to a preset dew-point of 0° C. or less;

transporting the finely divided powder, which has been supplied into the transportation pipe therethrough by using the compressed gas whose dew-point has been controlled;

controlling the amount of electric charge placed on the finely divided powder by friction when the transported finely divided powder collides against an inner wall of the transportation pipe by regulating the dew-point of the compressed gas; and uniformly spraying the finely divided powder in a discrete particle state onto a grounded sheet surface by using a two-dimensionally swinging nozzle, wherein the two-dimensionally swinging nozzle is independently controllable in both an X-direction and a Y-direction.

6. The finely divided powder spraying method of claim 5, wherein the dew-point of the compressed gas is regulated by humidifying the compressed gas by causing said compressed gas to pass through a dew-point controller comprising a water-adding unit having a pipe-shaped water penetrating hollow-thread film.

7. The finely divided powder spraying method of claim 5, wherein the dew-point of the compressed gas is regulated within the range of 0° C. to −70° C.

8.The finely divided powder spraying method of claim 5, wherein the dew-point of the compressed gas is regulated within the range of −20° C. to −60° C.

* * * * *